US009834969B2

(12) United States Patent
Kreyenborg et al.

(10) Patent No.: US 9,834,969 B2
(45) Date of Patent: Dec. 5, 2017

(54) ROLLER CARRIAGE FOR THE RECEPTION OF A SLIDING DOOR

(71) Applicant: DORMA Deutschland GmbH, Ennepetal (DE)

(72) Inventors: Ralf Kreyenborg, Ennepetal (DE); Thomas Vogler, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/938,645

(22) Filed: Nov. 11, 2015

(65) Prior Publication Data

US 2016/0138313 A1 May 19, 2016

(30) Foreign Application Priority Data

Nov. 14, 2014 (EP) ..... 14193359

(51) Int. Cl.

| | |
|---|---|
| ***E05D 15/06*** | (2006.01) |
| ***E06B 3/46*** | (2006.01) |
| ***E06B 3/54*** | (2006.01) |
| ***E06B 5/20*** | (2006.01) |

(52) U.S. Cl.

CPC ..... *E05D 15/0643* (2013.01); *E05D 15/063* (2013.01); *E05D 15/0634* (2013.01); *E05D 15/0647* (2013.01); *E05D 15/0652* (2013.01); *E06B 3/4636* (2013.01); *E06B 3/4681* (2013.01); *E06B 3/5454* (2013.01); *E06B 5/20* (2013.01); *E05Y 2800/422* (2013.01); *E05Y 2800/68* (2013.01)

(58) Field of Classification Search

USPC ..... 49/425

See application file for complete search history.

(56) References Cited

U.S. PATENT DOCUMENTS

| | | | | |
|---|---|---|---|---|
| 2,611,920 A * | 9/1952 | Borden | E05D 15/063 | 104/91 |
| 3,837,119 A * | 9/1974 | Conneally | E05F 1/16 | 16/78 |
| 5,165,142 A * | 11/1992 | Pilsbury | B66B 13/301 | 16/90 |
| 6,381,904 B1 * | 5/2002 | Tedescucci | A47K 3/34 | 16/87.4 R |

(Continued)

FOREIGN PATENT DOCUMENTS

| | | | | |
|---|---|---|---|---|
| CH | 0478938 B1 * | 1/1995 | E05F 5/003 | |
| CH | 2440732 B1 * | 1/2016 | E06B 5/20 | |
| DE | 102006021443 * | 11/2007 | E05D 15/063 | |

*Primary Examiner* — Katherine Mitchell
*Assistant Examiner* — Marcus Menezes
(74) *Attorney, Agent, or Firm* — Cantor Colburn LLP

(57) ABSTRACT

A roller carriage for the reception of a sliding door includes a roller module for the displaceable affixing at a roller running path and a basic body for the attachment to the sliding door. The roller module is configured of a first material and the basic body of a second material. The first material conducts structure-borne sound in a first sound conducting range and dampens the structure-borne sound in a second sound conducting range. The second material dampens structure-borne sound in the first sound conducting range and conducts structure-borne sound in the second sound conducting range.

13 Claims, 6 Drawing Sheets

(56) References Cited

U.S. PATENT DOCUMENTS

| | | | | |
|---|---|---|---|---|
| 6,540,068 | B1 * | 4/2003 | Wesson | E05D 15/063 193/35 R |
| 7,143,871 | B2 * | 12/2006 | Wesson | B66B 13/30 187/313 |
| 7,779,578 | B2 * | 8/2010 | Gray | E06B 3/01 49/409 |
| 8,955,195 | B2 * | 2/2015 | Chang | E05D 15/0639 16/105 |
| 2007/0261198 | A1 * | 11/2007 | Vogler | E05D 5/0246 16/87 R |
| 2010/0307063 | A1 * | 12/2010 | Bouthillier | E05D 15/063 49/425 |
| 2015/0020457 | A1 * | 1/2015 | Bouthillier | E05D 15/063 49/427 |

* cited by examiner

ROLLER CARRIAGE FOR THE RECEPTION OF A SLIDING DOOR

FIELD

The present disclosure relates to a roller carriage for receiving a sliding door, as well as a sliding door installation having a roller running path and at least one roller carriage, which is supported to be displaceable on the roller running path.

BACKGROUND

It is known to employ different types of doors for closing a door opening, such as sliding doors. Conventional sliding doors are usually provided with sliding door leaves, which are retained in corresponding clamping devices of a roller carriage. With the intention to guarantee the sliding functionality, such roller carriages are placed into roller running paths, which are attached to the wall and/or to the ceiling above the door opening. In conventional sliding doors, a movement is performed between an opened position and a closed position. In this case, corresponding bearing devices, in particular rollers, run on the roller running path. During this movement, it is possible that vibrations from the roller running path are introduced into the roller carriage. It is also conceivable that vibrations from the sliding door are introduced into the roller carriage. As in this case, often a plurality of individual structural components are combined with each other, and the connection between the roller carriage and the roller running path is just realized in a suspended manner, said respective vibration may result in noise emission. So the structure-borne noise generated in the respective structure and forwarded is emitted from at least one of the structures and is perceptible by the user of the sliding door installation as an acoustic frequency. The above-described vibration may increase within the entire system of the sliding door installation and, in this way, can even further increase the negative impression of a loud movement. In this case, the user notices the sound level during the movement of a sliding door as one of the main criteria, when it comes to evaluate the quality of the sliding door installation. Thus, a loud moving sliding door is a poor, respectively inferior product.

The present disclosure overcomes the above-described disadvantages of conventional sliding doors by providing a roller carriage that improves its running smoothness in a cost-efficient and simple way.

SUMMARY

Features and details, described in conjunction with the inventive roller carriage are obviously also valid in conjunction with the inventive sliding door installation, and respectively vice versa, such that mutual reference can be made with respect to the disclosure of individual aspects of the disclosure.

According to the disclosure, a roller carriage is provided for receiving a sliding door. The roller carriage includes a roller module for the displaceable affixing at a roller running path and a basic body is provided for attaching to the sliding door. An inventive roller carriage is distinguished in that the roller module is made from a first material and the basic body is made from a second material. In this case, the first material conducts structure-borne sound in a first sound conducting range, and in a second sound conducting range, said first material dampens the structure-borne sound. The second material conducts the structure-borne sound in the second sound conducting range and again dampens the structure-borne sound in the first sound conducting range.

An inventive roller carriage includes at least two structural components, the roller module and the basic body. In this case, further structural components may be provided and/or said two structural components may be composed of individual bodies. A roller carriage according to the idea of the present disclosure is an overall system, which fulfills at least two functions. On the one hand, the roller module allows for the displaceable affixing on the roller running path. Even if, already in this stage, the terminology of rollers is utilized, an affixing of bearing devices for rollers represents only one optional embodiment of an inventive roller carriage. Obviously for the displaceable bearing, such a roller carriage may likewise include a linear guidance, for example an anti-friction bearing or a linear drive. However, with regard to reduced complexity and reduced cost, the embodiment with rotatable rollers is preferred for such a bearing device. The second function provides the attachment of the sliding door. In this case, the attachment may be a clamped attachment.

According to the disclosure, the roller module and the basic body are separate structural components. each one, namely the roller module and/or the basic body, may in turn include a plurality of individual components, which are connected among each other. Thus, the roller module may include, for example, corresponding bearing devices in the shape of rotatably supported rollers. The basic body may include a plurality of individual structural components, such as for example further devices for additional functions. In addition to a height adjusting device, they may as well include a securing device, a fixing device or else a clamping device, by means of which the sliding door can be attached to the basic body.

According to the disclosure, the direction of movement by means of the roller carriage is freely selectable. Thus, a movement along a straight can be performed, just as well as a movement along a line of movement, which is curved or curved several times, is conceivable.

In this case, a displaceable affixing to a roller running path is to be understood for the respective embodiment of the bearing. In case, for example, bearing devices in the shape of individual rollers are provided, said rollers are inserted into a corresponding roller running path. If, for example, an anti-friction bearing is provided, affixing the roller module is realized on a corresponding sliding rail, respectively at a corresponding sliding rail.

According to the disclosure, there is a correlation of two different materials in the roller carriage. A configuration from a first material and a second material should be understood in this case that the roller module includes, at least to the largest extent with regard to its sound technical efficiency, the first material, respectively the second material. Obviously, add-on parts, respectively further structural components may include as well other materials. However, in particular in a portion in the force path between the accommodated sliding door and the roller running path, the two materials, namely the first material and the second material are exclusively, or essentially exclusively disposed.

A sound conducting range may refer for example to the type of sound. In the conducting function of a material, namely within a structure, the sound will propagate as structure-borne sound in different directions. In this case, in particular a longitudinal wave and a transverse wave are distinguished. In this case, a sound conducting range may define exactly one of said two orientations, respectively orientation directions of the sound. So it is conceivable the first material has a dampening property in the longitudinal wave range, whereas the second material includes a dampening effect for transverse waves. The corresponding conducting property is likewise configured to be complementary. In this case, obviously different sound conducting ranges may also overlap each other.

Sound conducting ranges may distinguish in addition or as an alternative likewise other types of sound. In this way, in particular different frequencies and/or different frequency amplitudes can be employed to differentiate different sound conducting ranges.

It is decisive that, at least in small portions, the two materials are configured to dampen each other. In other words, this means a structure-borne sound, which is generated or picked-up in the first material, will be at least partially dampened by the second material by means of the correspondingly complementary configured dampening property of the second material. In the reverse case, a structure-borne sound, which is generated in the second material or is picked-up by the latter, will be dampened by the first material by means of the complementary configured dampening property in exactly said sound conducting range. In the event the dampening property for the generated type of structure-borne sound is directly provided in the material, in which the structure-borne sound is generated, respectively picked-up, the dampening occurs even within said material.

As explained above, the two materials act so to say as sound specifically complementary or at least as partially sound specifically complementary to each other. This means the structure-borne sound, irrespective of the side from which it is introduced into the respective material, or structure-borne sound irrespective of what material it is generated in, will be superimposed by a dampening property of the opposite material or of the same material. This independency of the type of the sound achieves a dampening, which can be realized by means of a specific material combination. Without additional dampening functions, respectively dampening devices, just this material combination alone, which surprisingly was discovered, provides a dampening, which prevents structure-borne sound within the system of the roller carriage either completely, when the sound is created or dampens it when it is conducted in the roller carriage. Preventing structure-borne sound, respectively dampening structure-borne sound results in the user of such a sliding door installation perceiving the movement of the sliding door between the different positions as considerably quieter and therefore as of superior quality. So that a corresponding conducting, respectively transferring of structure-borne sound between the individual structural components of a roller carriage is guaranteed, they are usually in, respectively advantageously in a connection with each other. Thus, a sound-transferring contact may exist between the first material and the second material.

This may be provided by direct contact between the basic body and of the roller module. Also sound-technical transferring intermediate structural components are obviously conceivable according to the idea of the present disclosure.

It may be of advantage, if the roller module includes a transferring portion and the basic body includes a counter-transferring portion, wherein the transferring portion contacts the counter-transferring portion, in particular in full contact. Thus, there is a direct contact between the roller module and the basic body. In this case, the full contact may include a flat configured full contact. The contact just serves for providing a transfer of structure-borne sound between the two materials of the roller module and of the basic body. The larger the corresponding surface for such a transfer, the more efficiently the corresponding dampening property of the complementary material can act on the associated material. The inventive complementary dampening effect is increased such that the function of dampening, respectively prevention of structure-borne sound can be even further improved. In this case, contacting is preferably configured in two or more directions such that the corresponding transfer of structure-borne sound can be likewise provided in two or more directions. In this case, in particular different transfer directions are positioned vertically or essentially vertically to each other such that the contacting portion and the counter-contacting portion are likewise configured to be vertically or essentially vertically to each other. This arrangement results in that, in particular structure-borne sound waves, which vertically or essentially vertically oriented to each other, being transferable by means of one and the same transferring portion, respectively counter-transferring portion. The roller module presents in particular a first surface, for example a lateral surface of the roller module, which preferably, in a range of 80% and 100%, abuts in a contacting manner against the basic body. A contacting surface increased in this manner between said two structural components results in an improved sound transfer and thereby in an improved inventive dampening effect.

It is likewise advantageous, if, in an inventive roller carriage, the basic body and/or the roller module are configured to be monolithic. In particular an integral configuration or a configuration in one piece of the respectively structural component is to be understood by monolithic. This configuration allows for achieving considerable advantages during manufacturing. Also, the monolithic configuration of the respective structural component may achieve the advantage of providing a uniform and thus predictable propagation of the structure-borne sound within the structural component. Thereby, additional fixtures, respectively negative influence or reinforcements of the generated or picked-up structure-borne sound is even further prevented. Thereby, the dampening properties can be improved.

According to the disclosure, it is furthermore advantageous, if, in an inventive roller carriage, the first material of the roller module presents at least one of the following material parameters:

density between 7 kg/dm$^3$ and 9 kg/dm$^3$, shear modulus between 70 kN/mm$^2$ and 90 kN/mm$^2$, and E-modulus between 180 kN/mm$^2$ and 240 kN/mm$^2$.

The above enumeration is considered a non-exhaustive list. The density is in particular in a range of approximately 7.9 kg/dm$^3$, the shear modulus in the range of 80 kN/mm$^2$, and the E-modulus in the range of approximately 210 kN/mm$^2$. The above parameters will be later considered in relation to other parameters, and form an exemplary embodiment option of the feature of the first material to be provided by the disclosure with regard to the sound specification.

It is likewise advantageous, if, in an inventive roller carriage, the second material of the basic body presents at least one of the following material parameters:

density between 6 kg/dm$^3$ and 8 kg/dm$^3$, shear modulus between 30 kN/mm$^2$ and 50 kN/mm$^2$, and E-modulus between 70 kN/mm$^2$ and 100 kN/mm$^2$.

The above enumeration is considered a non-exhaustive list. In this case, for the second material the E-modulus may be preferably in the range of approximately 85 kN/mm$^2$, the shear modulus in the range of 40 kN/mm$^2$, and the density in the range of approximately 6.7 kg/dm$^2$. In this case, again corresponding correlations can be achieved in a particularly simple and inexpensive way, in order to provide the inventive complementary dampening property between the first and the second materials.

Moreover, it is advantageous, if, in an inventive roller carriage, the basic body includes a glass clamp having at least one of the following material parameters:

density between 7 kg/dm3 and 9 kg/dm$^3$, shear modulus between 70 kN/mm$^2$ and 90 kN/mm$^2$, and E-modulus between 180 kN/mm$^2$ and 240 kN/mm$^2$.

The above enumeration is considered a non-exhaustive list. In this case, in particular the first material of the roller module is employed for the glass clamp. So the glass clamp may have for example an E-modulus in the range of approximately 210 kN/mm$^2$, a shear modulus in the range of 80 kN/mm$^2$, and a density in the range of approximately 7.9 kg/dm$^2$. The corresponding correlations, which may result in the inventive configuration of the dampening material effect, will be illustrated later for this case as well. The multiplication of the dampening should be noted in particular, if not only a first material pairing between the first and the second materials is provided but also a linkage of three or more material pairings. In this case, in particular an alternating configuration of different materials should be noted such that for example structural components can be put together as follows: Structural component 1 with the first material, structural component 2 with the second material, and structural component 3 with the third material. Accordingly, the corresponding contacting row is composed of structural component 1 to structural component 2 and structural component 2 to structural component 3. The dampening effect can be further reinforced, so to say as a dampening cascade, respectively as a dampening chain. Such a cascade is configured in particular along the force path as a roller running path, a roller module, a basic body and a glass clamp. In this case, the following combination options are conceivable as a cascade for the individual structural components:

| STRUCTURAL COMPONENT 1 | STRUCTURAL COMPONENT 2 | STRUCTURAL COMPONENT 3 | STRUCTURAL COMPONENT 4 |
|---|---|---|---|
| roller running path | roller module | basic body | glass clamp |
| roller module | basic body | glass clamp | |
| roller running path | roller module | basic body | |

It is likewise advantageous, if, in an inventive roller carriage, the basic body includes a U-shaped glass clamp for the clamped attachment of the sliding door. In this case, the glass clamp may be in particular the one according to the preceding paragraph. A U-shaped configuration, in particular in the shape of two U-shaped glass clamps, which are disposed at both ends of the basic body, allows for a particularly simple and inexpensive attachment possibility for the sliding door. The respective glass clamp serves thereby for picking-up structure-borne sound from the sliding door, which is picked-up from there and conducted further, respectively generated in the sliding door. When attaching by means of a corresponding U-shaped glass clamp, a deformation of said U-shaped glass clamp might happen. However, it is preferred, if said U-shaped glass clamp includes at least one displaceable clamping plate, which is able to increase or reduce a gap within the open U. By reducing the corresponding gap, the clamping force and thereby the clamping effect can be applied to the sliding door. In this case, the glass clamp is configured in particular from a material as explained in the above paragraph. In this case, for an improved transfer of the sound between said two structural components, the glass clamp may abut against the basic body, in particular in full contact. Also, according to the present disclosure, it is conceivable, if the glass clamp partially or completely surrounds the basic body.

Furthermore, it is advantageous, if, in an inventive roller carriage, the roller module is connected to the basic body non-positively, positively and/or by friction connection, in particular by means of attachment screws. A non-positive, a positive and/or a friction connection serve in this case in particular to provide the corresponding possibility of transferring structure-borne sound. It is said transfer possibility, which allows so to say for providing the exchange of dampening properties complementarily between the two materials and to provide it to the respective neighboring material. Obviously, also two or more different connection types combined to each other may be employed according to the idea of the present disclosure.

A further advantage may be provided, if, in an inventive roller carriage, the roller module includes a bearing device with at least one, in particular at least two rotatable rollers. In this case, basically any form of bearing device may be employed, namely also a sliding bearing or else a linear drive having a corresponding anti-friction bearing. However, in order to even further pursue the reduction of generating structure-borne sound, a configuration of the bearing device with at least one roller is advantageous. In this case, a variation from dynamic friction to rolling friction may achieve a considerably reduced vibration. The generation of structure-borne sound is in this case already reduced prior to occurring of the inventive acting dampening effect. Preferably, the individual rollers run on ball bearings and have a reduced roughness at their surface.

Another advantage may be, if, in an inventive roller carriage, said at least one roller is configured from plastic material, in particular having one of the following material parameters:

density between 1 kg/dm$^3$ and 2 kg/dm$^3$, shear modulus between 2 kN/mm$^2$ and 6 kN/mm$^2$, and E-modulus between 2 kN/mm$^2$ and 3 kN/mm$^2$.

The above enumeration is considered a non-exhaustive list. In this case, the E-modulus is preferably in the range of approximately 2.6 kN/mm$^2$, the shear modulus in the range of approximately 4 kN/mm$^2$, and the density is preferably in the range of approximately 1.4 kg/dm$^3$.

It is likewise an advantage, if, in an inventive roller module, the E-modulus of the first material to the E-modulus of the second material is configured to be between 1.5:1 and 2.5:1 and/or the shear modulus of the first material to the shear modulus of the second material to be between 2.5:1 and 3.5:1. In the following is indicated a longer listing of possible correlations, respectively ratios, which are likewise able to act in an inventive manner. In particular a corresponding inversion of the materials may likewise achieve the same or an improved effect. In this case, the stronger material with regard to the functionality of the E-modulus and/or the shear modulus will be employed for the structural component being subject to higher mechanical load. In particular corresponding ratios are combined, as will be explained in the following. In addition a sound technical density may be defined for the respective material. Under sound technical density is to be understood that the material density is multiplied by the quotient of E-modulus divided by the shear modulus [density×(E-modulus/shear modulus)]. Said sound specific density for the first material results in a range of approximately 10 kg/dm$^3$ to approximately 30 kg/dm$^3$ and in a similar range of values for the second material. With the two selected materials, there are in particular three basic possibilities. It is conceivable to configure both materials within the framework of one or more of the value ranges of the individual parameters and to take into account the object of the inventive complementary dampening. Furthermore, it is conceivable to generate the complementary dampening based on the listed parameter ratios. Another option involves the selection of at least one parameter for one of the two materials, wherein subsequently the corresponding parameter for the second material results from the indicated ratios. In the following listing, the described ratios of the sound specific density between the individual structural components are decisive. In the following, the ratio ranges, which according to the disclosure are able to provide the specific ratio, will be explained in detail for the E-modulus, the shear modulus, the density, and the sound specific density.

Shear Modulus:
roller module:basic body=2.5:1 to 3.5:1
basic body:glass clamp=1:2.5 to 1:3.5
roller module:basic body:glass clamp:
–2.5:1:2.5 to 2.5:1:3.5
–3.5:1:2.5 to 3.5:1:3.5

E-Modulus:
roller module:basic body=1.5:1 to 2.5:1
basic body:glass clamp=1:1.5 to 1:2.5
roller module:basic body:glass clamp:
–1.5:1:1.5 to 1.5:1:2.5
–2.5:1:1.5 to 2.5:1:2.5

Density:
roller module:basic body=1:1.5 to 1.5:1
basic body:glass clamp=1.5:1 to 1:1.5
roller module:basic body:glass clamp:
–1:1.5:1 to 1:1:1
–1.5:1:1.5 to 1:1:1

Sound Specific Density:
roller module:basic body=1:0.5 to 1:1.7
basic body:glass clamp=0.5:1 to 1.7:1
roller module:basic body:glass clamp:
–1:0.5:1 to 1:1.7:1
–0.5:1:0.5 to 1.7:1:1.7

Explicitly these ranges of values, respectively ratios are solutions, which fulfill the dampening and conducting properties defined according to patent claim 1 of the present application. Accordingly, a combination of materials within the following range of ratios is accordingly considered a material pairing following the idea of the present disclosure according to claim 1 of the present application.

Furthermore, it may be advantageous, if, in the inventive roller carriage, each material has a sound specific density, which results from the material density multiplied by the quotient of the E-modulus divided by the shear modulus of the respective material, wherein the sound specific density of the first material to the sound specific density of the second material is configured to be in the range between 1:0.5 and 1:1.7. In this case, it is a particularly advantageous correlation for achieving the inventive complementary dampening effect. Thus, preferably independently of the type and the direction of sound, said dampening function is provided.

Another subject matter of the present disclosure is a sliding door installation including a roller running path and at least one inventive roller carriage, which is supported in the roller running path to be displaceable according to the present disclosure. Obviously, also two roller carriages may be provided, to which a sliding door is already attached. The inventive sliding door installation thus offers the same advantages as those described in detail with regard to an inventive roller carriage.

BRIEF DESCRIPTION OF THE DRAWINGS

Further advantages, features and details of the disclosure will result from the following description, in which exemplary embodiments of the disclosure are described in detail, reference being made to the drawings. In the drawings.

DETAILED DESCRIPTION OF THE DRAWINGS

Figure 1:
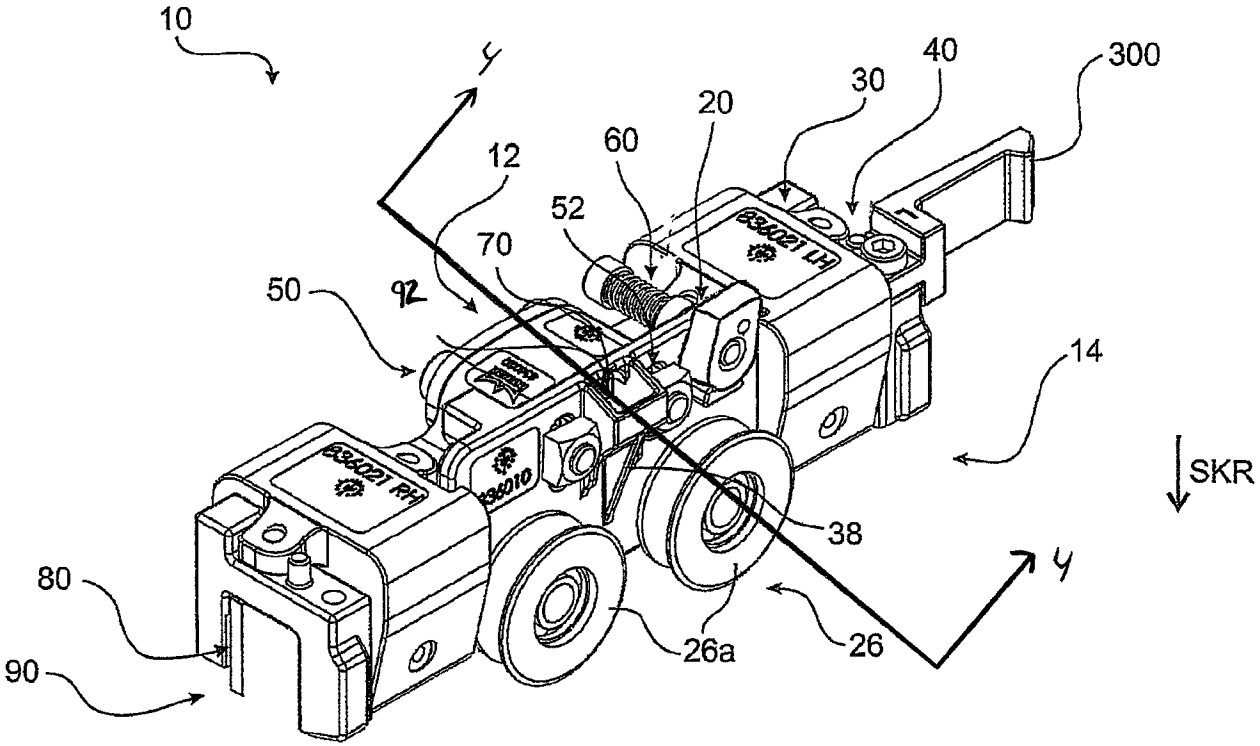
FIG. 1 is a perspective view of a roller carriage according to the disclosure.

Turning to FIG. 1, a roller carriage 10 includes two structural components, the roller module 20 and the basic body 30. In this case, both structural components, namely the roller module 20 and the basic body 30 include a plurality of individual parts. Said individual parts will be briefly explained in the following.

Figure 3:
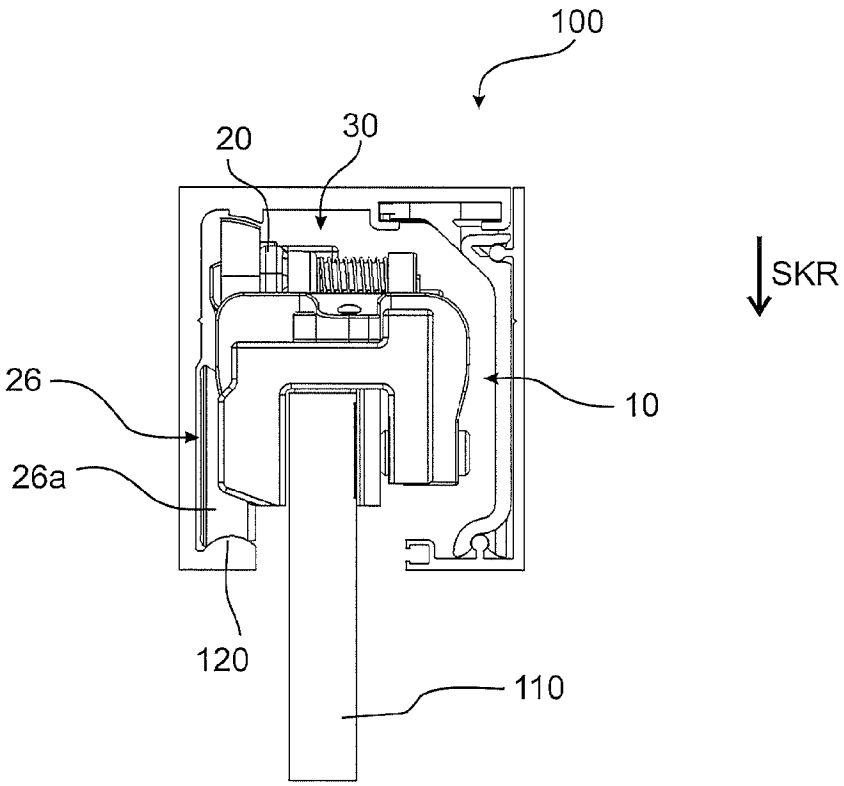
FIG. 3 is an elevational view of a roller carriage as shown in FIG. 2 in a roller running path.
Figure 5:
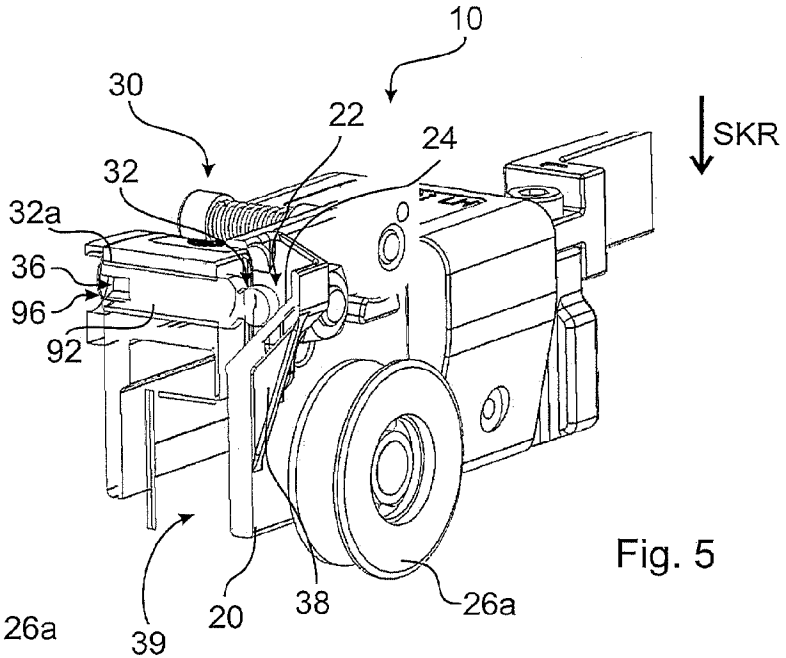
FIG. 5 is a perspective view of the roller carriage shown in FIG. 4.
Figure 4:
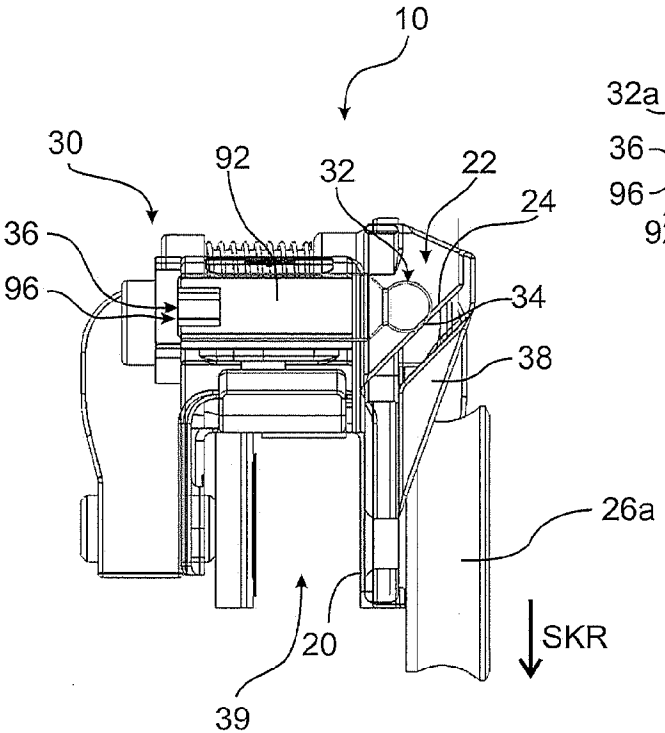
FIG. 4 is a cross-sectional view of a roller carriage as shown in FIG. 1 through the line 4-4.

Here, the roller module 20 is equipped with a bearing device 26 having two rollers **26*a*, which are supported to be rotatable at a basic body of the roller module 20. Said rollers 26*a* can be placed onto, respectively inserted into a roller running path 120, as can be clearly seen in FIG. 2 and FIG. 3. A part of a height adjusting device 70 is provided furthermore at the roller module 20. The detailed components of said height adjusting device 70 are in particular illustrated in the FIGS. 4 and 5. Thus, a first adjusting means 32 is provided, which by means of a manipulation interface 36 is able to perform an adjusting movement. As in this case, the first adjusting means 32 is configured as a threaded bolt in an adjusting thread, a rotary motion is performed at the manipulation interface 36, which motion simultaneously produces a linear translatory motion of the first adjusting means 32. Via a corresponding contacting portion 34, the first adjusting means 32 is in operative connection with a counter-contacting portion 24 of the second adjusting means 22 of the roller module 20**. In this case, the explicit action of said adjusting device relates to converting the adjusting movement into a fine-tuning movement along the direction of gravity SKR.

As can be seen in FIG. 1, the roller carriage 10 is equipped with a plurality of different mounting devices 90, which are able to provide different mounting functions. In this case, the already described fine-tuning function of the height of the sliding door 110 is provided by means of the mounting device 90 in the shape of the height adjusting device 70. Furthermore, a mounting device in the shape of a securing device 50 is provided, which, after completed fine-tuning of the height of the sliding door 110, provides a clamping fixing between the basic body 30 and the roller module 20.

Here, a further mounting device 90 includes an accessory device 40, which is provided by means of a corresponding interface and an affixed accessory module 300. Moreover, a lift-off protection device 60 is a mounting device, which provides a lift-off protection against unwanted removal of the roller carriage 10 out of the position in which it is inserted into the roller running path 120. Furthermore, an attachment device 80 is provided as a glass clamp for a mounting device, in order to affix the sliding door 110 in a clamping manner.

All mounting devices include at least one mounting means 92, in order to be able to perform a corresponding mounting movement. Moreover, a manipulation interface is provided, intended to allow for performing exactly said mounting movement with the mounting means.

As furthermore revealed in FIG. 1, the roller carriage 10 has different sides, namely the first side 12 and the second side 14. In this case with regard to their manipulation interface 96, all mounting devices are preferably aligned from the same side, namely the first side 12 opposite to the second side 14, on which the bearing device 26 is disposed. This arrangement offers a considerably simpler access.

Figure 2:
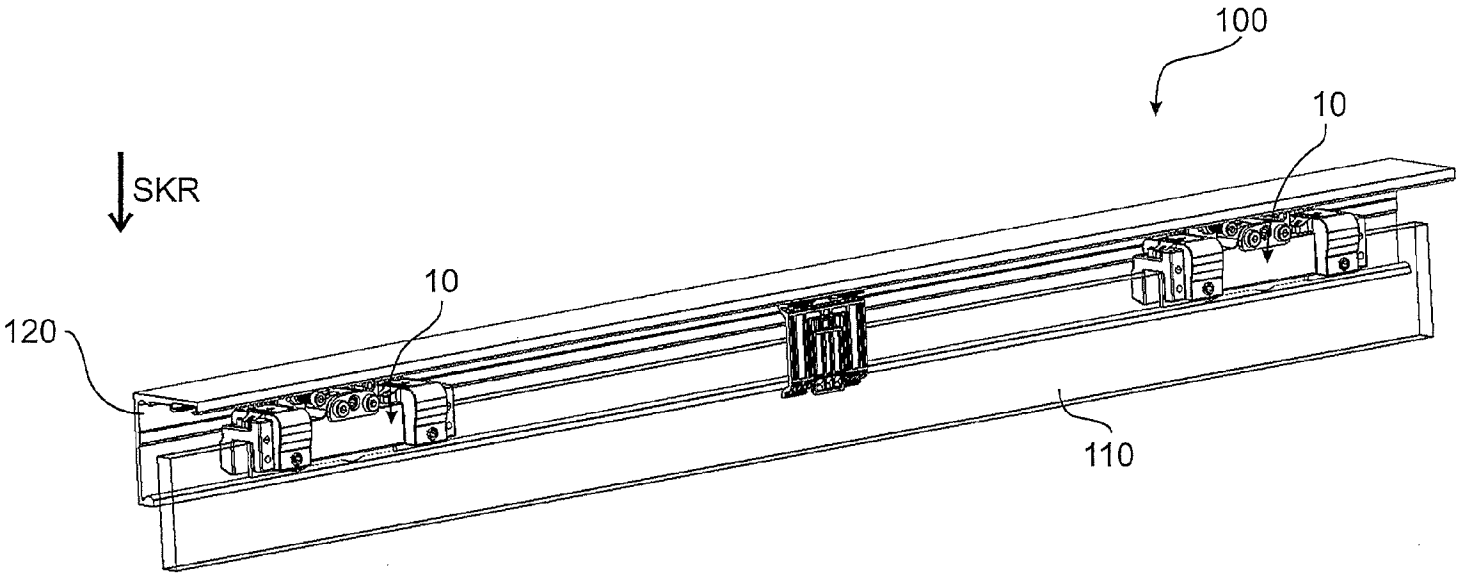
FIG. 2 is a perspective view of a sliding door installation having at least one roller carriage as shown in FIG. 1.

FIG. 2 reveals how a sliding door 110 is retained by means of two roller carriages 10 according to FIG. 1, and that said two roller carriages 10 are already inserted into the roller running path 120. In a lateral illustration according to FIG. 3, in particular the correlation of the rollers 26*a* with the roller running path 120 is well visible.

Figure 6:
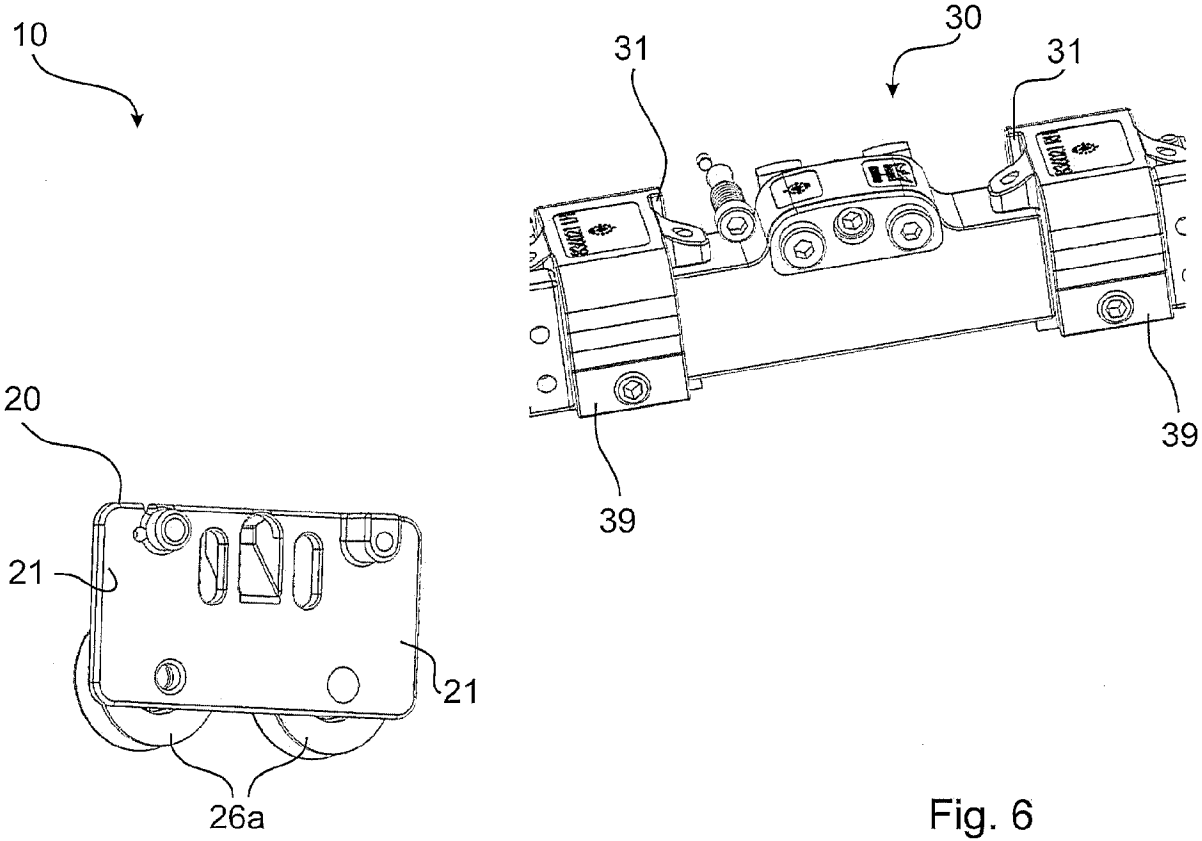
FIG. 6 is a perspective view of the basic body and the roller module as shown in FIG. 1.

FIG. 6 shows how basically two structural components can be distinguished from each other. In this case, the components are the roller module 20 and the basic body 30. Here, rollers 26*a*, which are configured in this case from plastic material, of the bearing device 26 are visible at the roller module 20. Also, the transferring portions 21 are visible, which are able to reach full contact with the appropriate counter-transferring portions 31 of the basic body 30. Moreover, the basic body includes two U-shaped glass clamps 39, in which the sliding door 110 can be disposed in a clamped attachment.

Figure 7:
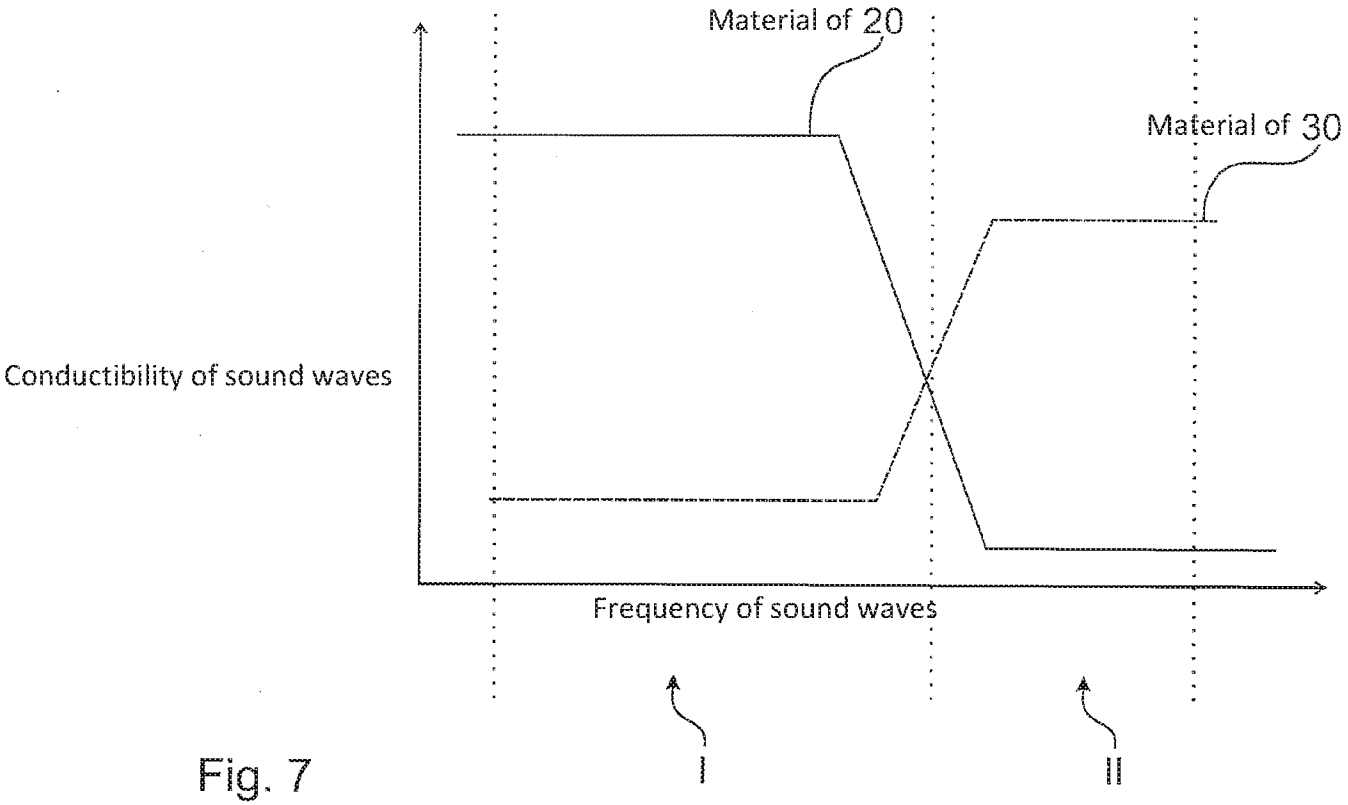
FIG. 7 is hypothetical chart showing abstract correlation of two materials in two different sound conducting ranges according to the roller module shown in FIG. 1.

If the two structural components of the basic body 30 and the roller module 20 are attached to each other, an inventive material pairing is the result. The two materials, namely the first material of the roller module 20 and the second material of the basic body 30 have sound technical properties in this case, as illustrated in an abstract way in FIG. 7. In this case, the corresponding conductibility of structure-borne sound is illustrated on the y-axis, whereas a corresponding distinction in different directions, respectively of different types of structure-borne sound is represented on the x-axis. For example the angle of propagation of the structure-borne sound can be plotted on the x-axis. Also, a frequency spectrum or an amplitude spectrum can be plotted on the x-axis. It is well visible, that the two basic sound conducting ranges I and II can be clearly distinguished from each other. The corresponding resulting curves for the first material and the second material, namely for the roller module 20 and the basic body 30, are in this case oriented to be complementary, respectively essentially complementary. In the event a corresponding structure-borne sound from said sound conducting range I is generated in the sound conducting range I in the roller module 20 or is picked-up therein, said generated or picked-up structure-borne sound is conducted farther. Said structure-borne sound is transferred via the transferring portion 21 and the counter-transferring portion 31 onto the basic body 30. However, in exactly said sound conducting range I, the basic body is equipped with a very poor sound conductance and thereby with a dampening property. In the second material of the basic body 30, the structure-borne sound is now conducted very slowly or not at all, and its amplitude is dampened in this way. The overall amount of sound, which the system of the roller carriage emits, is thereby reduced. Thus, FIGS. 6 and 7 show in a very illustrative way, in which way the complementary dampening property of the two different materials of roller module 20 and basic body 30 provide the dampening effect within the system.

The above explanation of the embodiments describes the present disclosure exclusively based on examples. Obviously, individual features of the embodiments, as long as technically reasonable, can be freely combined with each other without leaving the scope of the present disclosure.

The invention claimed is:

1. A roller carriage for a sliding door comprising:

a roller module structured for affixing on a roller running path, and an attachment body structured for connecting the roller carriage to the sliding door, wherein the roller module is made of a first material and the attachment body is made of a second material, wherein the first material conducts structure-borne sound in a first sound conducting range and dampens the structure-borne sound in a second sound conducting range, and the second material dampens the structure-borne sound in the first sound conducting range and conducts the structure-borne sound in the second sound conducting range, wherein the roller carriage includes a U-shaped clamp disposed on a lower end of the roller module and configured for attachment to the roller running path, and further includes a protection device disposed on top of the roller module configured to secure the roller carriage from lifting off the roller running path, and wherein, when seen from a side, the protection device is located above the roller running path.

2. The roller carriage according to claim 1, wherein the roller module includes a transferring portion and the attachment body includes a counter-transferring portion, wherein the transferring portion contacts the counter-transferring portion in full contact.

3. The roller carriage according to claim 1, wherein the attachment body or the roller module are monolithic.

4. The roller carriage according to claim 1, wherein the first material of the roller module includes at least one of the following material parameters:

density between 7 $kg/dm^3$ and 9 $kg/dm^3$, shear modulus between 70 $kN/mm^2$ and 90 $kN/mm^2$, and E-modulus between 180 $kN/mm^2$ and 240 $kN/mm^2$.

5. The roller carriage according to claim 1, wherein the second material of the attachment body includes at least one of the following material parameters:

density between 6 $kg/dm^3$ and 8 $kg/dm^3$, shear modulus between 30 $kN/mm^2$ and 50 $kN/mm^2$, and E-modulus between 70 $kN/mm^2$ and 100 $kN/mm^2$.

6. The roller carriage according to claim 1, wherein the attachment body includes a clamp having at least one of the following material parameters:

density between 7 $kg/dm^3$ and 9 $kg/dm^3$, shear modulus between 70 $kN/mm^2$ and 90 $kN/mm^2$, and E-modulus between 180 $kN/mm^2$ and 240 $kN/mm^2$.

7. The roller carriage according to claim 1, wherein the roller module is connected to the attachment body directly, indirectly, or by friction connection.

8. The roller carriage according to claim 1, wherein the roller module includes a bearing device having at least one rotatable roller.

9. The roller carriage according to claim 8, wherein the at least one roller is configured from plastic material, having one of the following material parameters:

density between 1 $kg/dm^3$ and 2 $kg/dm^3$, shear modulus between 2 $kN/mm^2$ and 6 $kN/mm^2$, and E-modulus between 2 $kN/mm^2$ and 3 $kN/mm^2$.

10. The roller carriage according to claim 9, wherein the E-modulus of the first material to the E-modulus of the second material is between 1.5:1 and 2.5:1, or the shear modulus of the first material to the shear modulus of the second material between 2.5:1 and 3.5:1.

11. The roller carriage according to claim 1, wherein each material has a sound specific density, which results from a material density multiplied by the quotient of the E-modulus divided by the shear modulus of the respective material, wherein the sound specific density of the first material to the sound specific density of the second material is configured to be in the range between 1:0.5 and 1:1.7.

12. A sliding door installation, including a roller running path and at least one roller carriage supported to be displaceable in a roller on the roller running path, wherein the at least one roller carriage includes a roller module for affixing on the roller running path, and an attachment body for connecting the at least one roller carriage to at least one sliding door, wherein the roller module is made of a first material and the attachment body is made of a second material, wherein the first material conducts structure-borne sound in a first sound conducting range and dampens the structure-borne sound in a second sound conducting range, and the second material dampens the structure-borne sound in the first sound conducting range and conducts the structure-borne sound in the second sound conducting range.

13. The sliding door installation according to claim 12, wherein the at least one sliding door is supported to be displaceable in the roller running path with at least two roller carriages.

* * * * *